US005646721A

United States Patent [19]

Sugihara et al.

[11] Patent Number: 5,646,721

[45] Date of Patent: Jul. 8, 1997

[54] IMAGE FORMING APPARATUS FOR SUPPLYING POWER TO MEMBERS OF A ROTARY DEVELOPING DEVICE

[75] Inventors: Kazuyuki Sugihara; Tomoji Ishikawa, both of Yokohama; Katsuhiro Kosuge, Tokyo, all of Japan

[73] Assignee: Ricoh Company, Ltd., Tokyo, Japan

[21] Appl. No.: 455,622

[22] Filed: May 31, 1995

[30] Foreign Application Priority Data

Jun. 1, 1994 [JP] Japan ..... 6-143817

[51] Int. Cl.[6] ..... G03G 15/00; G03G 15/01

[52] U.S. Cl. ..... 355/326 R; 355/200; 439/151; 439/700; 439/824

[58] Field of Search ..... 355/200, 326 R, 355/327, 245; 439/700, 824, 151

[56] References Cited

U.S. PATENT DOCUMENTS

| | | | |
|---|---|---|---|
| 3,987,756 | 10/1976 | Katayama et al. | 355/327 X |
| 5,243,395 | 9/1993 | Koike et al. | 355/327 |

FOREIGN PATENT DOCUMENTS

| | | |
|---|---|---|
| 62-11867 | 1/1987 | Japan . |
| 62-112181 | 5/1987 | Japan . |
| 62-209468 | 9/1987 | Japan . |
| 2-18582 | 1/1990 | Japan . |
| 4-338774 | 11/1992 | Japan . |
| 5-346731 | 12/1993 | Japan . |

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

An image forming apparatus of the type having a rotary developing device or revolver, and a power supply device. When the revolver is rotated to bring one of its developing sections to a developing position, the end of a developing roller disposed in the developing section faces a bracket mounted on a rear wall included in the apparatus body. A retractable rod-like terminal is mounted on the bracket and constantly biased by a spring. A bias for development is applied from a bias circuit to the developing roller via the retractable terminal.

1 Claim, 6 Drawing Sheets

IMAGE FORMING APPARATUS FOR SUPPLYING POWER TO MEMBERS OF A ROTARY DEVELOPING DEVICE

BACKGROUND OF THE INVENTION

The present invention relates to a copier, facsimile apparatus, printer or similar image forming apparatus and, more particularly, to an image forming apparatus having a rotary developing device having a plurality of developing sections arranged around the axis of rotation and rotatable about the axis to bring any one of the developing sections to a developing position where an image carrier is located, and a power supply device therefor.

An image forming apparatus of the type described is disclosed in, for example, Japanese Patent Laid-Open Publication No. 61-285468 and includes a power supply device for supplying power to a lamp for sensing toner concentration. The lamp is mounted on a rotary developing device, or revolver, and supplied with power by way of a slidable member positioned at the center of the revolver. The above document also pertains to a method of maintaining a preselected gap between a developing roller and a photoconductive drum by causing the abutment rollers of developing rollers, disposed in the respective developing sections, to get on the drum due to the rotation of the revolver. The document proposes an implementation for preventing, when the abutment rollers hit against the drum, the exposure from becoming irregular at an image writing position and preventing toner on the developing roller from depositing on the drum despite the resulting impact or vibration. Specifically, the apparatus includes first moving means for moving a support supporting the plurality of developing sections, and second moving means for moving the individual developing section relative to the support. Before the developing section at the developing position is replaced with another, it is retracted into the support.

While the power supply device of the above document concentrates on the power supply to the lamp, it is also applicable to other members disposed in the revolver that need power, e.g., developing rollers to which a bias for development should be supplied. However, it is likely that the power supply fails due to the defective contact of the slidable member with the desired member, depending on the configuration of the slidable member. For example, assume that the slidable member is implemented as a conductive brush in order to ensure the power supply against some inaccuracy in the assembly of the revolver and the apparatus body. Then, the brush is apt to collapse and fail to contact the terminal of the other member as the apparatus is operated for a long period of time. On the other hand, when use is made of a rigid terminal free from such deformation, the revolver and apparatus body should be assembled with strict accuracy, resulting in an increase in cost. Moreover, it is likely that the distance between the rigid terminal and the other member changes due to a play between interconnected members and wear attributable to aging, preventing them from contacting accurately.

Furthermore, the mechanism for preventing the developing sections and drum from colliding with each other, as proposed in the above document, has a problem that toner drops from, for example, the developing rollers.

SUMMARY OF THE INVENTION

It is, therefore, an object of the present invention to provide an image forming apparatus capable of surely in a supplying power to a desired member disposed rotary developing device, and a power supply device therefor.

It is another object of the present invention to provide an image forming apparatus capable of reducing the fall of a developer from a developer carrier during the rotation of a rotary developing device.

In accordance with the present invention, in an image forming apparatus having a rotary developing device having a plurality of developing sections arranged around the axis of rotation and rotatable to bring any one of the developing sections to a developing position where an image carrier is located, a power input terminal is located at a predetermined position on one end of the developing device in the axial direction of the developing device. A power output terminal is located at a predetermined position on the body of the apparatus which faces a path on which the power input terminal moves during rotation of the developing device. One of the power input terminal and power output terminal comprises a retractable member constantly biased toward and retractable from the other terminal. Power is supplied from the body to the developing unit when the retractable member contacts the other terminal.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
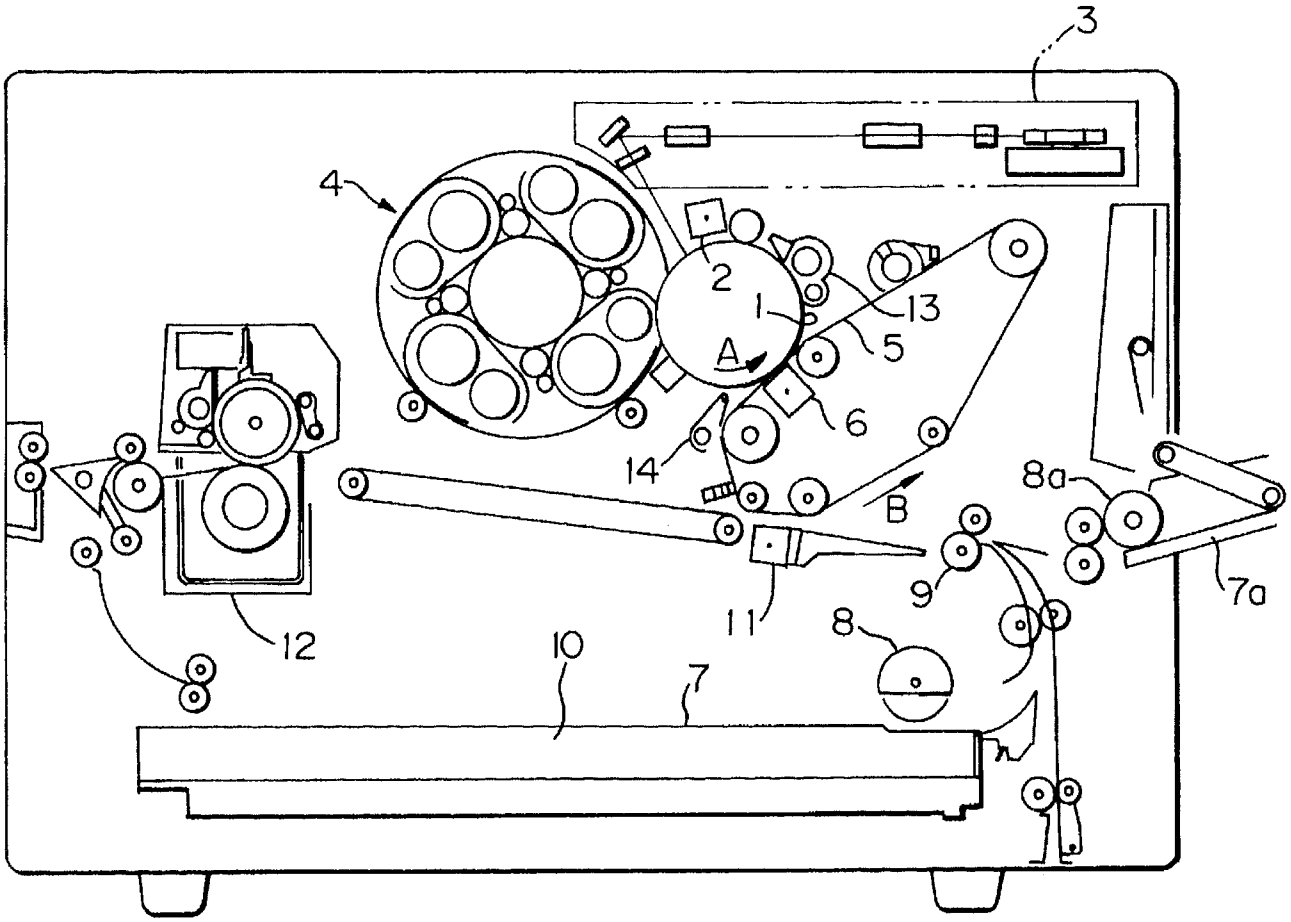
FIG. 1 is a section showing an image forming apparatus embodying the present invention.

Referring to FIG. 1 of the drawings, an image forming apparatus embodying the present invention is shown and implemented as a color electrophotographic printer by way of example. As shown, the printer has an image carrier in the form of a photoconductive drum 1. While the drum 1 is rotated in a direction indicated by an arrow A, a main charger 2 uniformly charges the surface of the drum 1. Laser optics 3 exposes the charged surface of the drum I on the basis of image data fed thereto. As a result, a latent image is electrostatically formed on the drum 1. The image data is one of yellow, magenta, cyan and black image data generated by separating a desired full-color image. The latent image is developed by preselected one of yellow, magenta, cyan and black toner stored in a rotary developing device, or revolver, 4 which will be described. Consequently, the latent image turns out a toner image. This procedure is repeated to sequentially form yellow, magenta, cyan and black toner images on the drum 1.

An intermediate transfer belt 5 is rotated in synchronism with the drum 1 in a direction indicated by an arrow B in FIG. 1. The yellow, magenta, cyan and black toner images are sequentially transferred to the belt 5 one above the other by a primary transfer charger 6. A paper 10 is fed from either a duplex copy/automatic paper feed cassette 7 or a manual paper feed tray 7*a* to an image transfer position by a pick-up roller 8 or 8*a* and a registration roller pair 9. A secondary transfer charger 11, located at the image transfer position, transfers the composite toner image from the belt 5 to the paper 10. A fixing unit 12 fixes the toner image on the paper 10. Thereafter, the paper 10 is driven out the printer as a full-color printing. The fixing unit 12 is of the type fixing a toner image with a heat roller or similar heating member. Hence, the temperature inside the revolver 4, partly adjoining the fixing unit 12 as shown in FIG. 1, is apt to rise. A measure of the temperature elevation of the revolver 4 will be described in detail later.

After the image transfer, the toner remaining on the drum 1 is removed by a drum cleaner 13. Likewise, the toner left on the belt 5 is removed by a belt cleaner 14.

Figure 2:
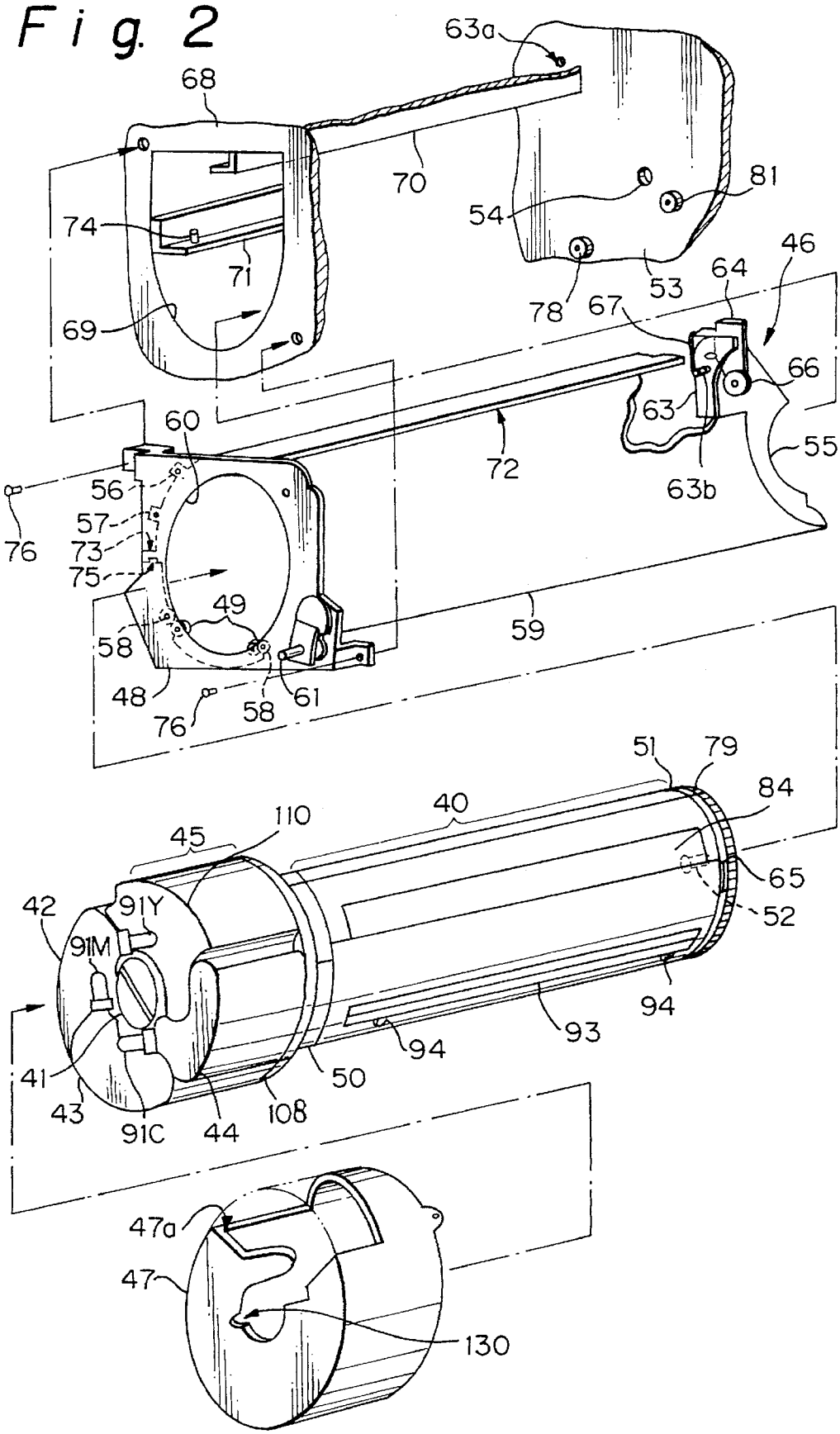
FIG. 2 is an exploded external perspective view of a rotary developing device included in the embodiment.

A reference will be made to FIGS. 2, 3, 4, 5A and 5B for describing the revolver 4 specifically. As shown in FIG. 2, the revolver 4 is generally made up of a substantially cylindrical developing unit 40 and a toner cartridge unit 45. The developing unit 40 has four developing sections storing, for example, black, cyan, yellow and magenta toner, respectively. The developing unit 40 is rotatable about its own axis inside of the printer. The toner cartridge unit 45 is mounted substantially coaxially on the front end of the developing unit 40 with respect to the axis of the unit 40. The unit 45 is rotatable about the above axis integrally with the unit 40. The two units 40 and 45 will be collectively referred to as a revolver developing unit hereinafter. The revolver developing unit is supported by a casing 46 which is slidable relative to the printer body substantially in parallel to the axis mentioned above. A cover 47 is unmovably mounted to a front support wall 48 included in the casing 46, covering the toner cartridge unit 45.

Two support rollers 49, for example, are rotatably mounted on the front support wall 48 and support a disk-like front end wall 50 included in the developing unit 40. A tapered stub 52 protrudes from the center of a disk-like rear end wall 51 also included in the developing unit 40. The printer body has a rear wall 53 in which a hole 54 is formed. The tapered stub 52 is rotatably received in the hole 54. In this condition, the revolver developing unit is positioned in the printer body such that its axis is substantially parallel to the axis of the drum 1 in substantially the same horizontal plane, as shown in FIG. 1.

More specifically, the casing 46 has, in addition to the front support wall 48, a rear support wall 55 and a side cover 59 affixed to the walls 48 and 55 at opposite ends thereof and reinforced by tie rods 56, 57 and 58. In the illustrative embodiment, the side cover 59 is used to prevent the temperature inside the revolver 4 from rising, as will be described later. The front wall 48 is formed with an opening 60 for the insertion of the revolver developing unit. A motor 61 and a gear train to be driven thereby, as well as the support rollers 49, are mounted on the front wall 48. The motor 61 drives replenishing rollers disposed in the toner cartridge unit 45, as will be described later. A flat piece 63 is affixed to the tie rods 56 and 57 in the vicinity of the rear wall 55. A positioning pin 63*b* is studded on the flat piece 63 in such a manner as to mate with a positioning hole 63*a*formed in the printer body rear wall. A bracket 64 supports a positioning roller 66 and has its base end pivotably supported by part of the pin 63*b* intervening between the piece 63 and the rear wall 55. The bracket 64 is constantly biased by a spring 67 such that the roller 66 drops in a recess 65 formed in a predetermined position on the circumference of the rear wall 51 of the developing unit 40 (see also FIG. 5A).

The printer body has a front wall 68 formed with an opening 69 for the insertion of the casing 46 supporting the revolver developing unit. An upper guide 70 and a lower guide 71 are affixed to the opposite walls 53 and 68 of the printer body and slidably support the casing 46. Portions 72 and 73 to be guided by the guides 70 and 71, respectively, are provided on the top and the side of the side cover 59 of the casing 46. A guide pin 74 extends upward from the guide 71 and is received in a channel 75 formed in the bottom of the portion 73. The channel 75 is bent halfway such that only predetermined front part is closer to the drum 1 than the rear part. Hence, when the casing 46 is slid into or out of the printer body, the channel 75 causes it move away from the drum 1. When the casing 46 is fully inserted into the printer body, the channel 75 locates the revolver developing unit at a preselected position relatively close to the drum 1.

When the casing 46 is inserted into the printer body, the tapered tip of the positioning pin 63*b* begins to enter the positioning hole 63*a* immediately before the end of the insertion. At the end of the insertion, the pin 63*b* and hole 63*a* cooperate to position the rear wall 55 and bracket 64 of the casing 46 accurately in the printer body. When the casing 46 is pulled out of the printer body, the rear end of the revolver developing unit is supported by the rear wall 55 of the casing 46. Immediately before the casing 46 is fully inserted into the printer body, the tapered stub 52 on the rear end of the revolver developing unit begins to enter the hole 54, causing the rear end to rise. At the end of the insertion, the rear end of the unit is fully raised above the wall 55. In this condition, the front wall 48 of the casing 46 is fastened to the front wall 68 of the printer body by, for example, screws 76. Consequently, the revolver developing unit has its front end supported by the rollers 49 of the front wall 48 which is accurately positioned relative to the printer body. Also, the rear end of the unit is positioned and rotatable relative to the rear wall 53 of the printer body.

A revolver drive gear 78 is mounted on the rear wall 53 of the printer body and driven by a stepping motor or similar motor, not shown. A revolver input gear 79 is fastened to the rear of the rear wall 51 of the developing unit 40 and provided with substantially the same diameter as the wall 51. The gear 78 causes the revolver developing unit to rotate in mesh with the gear 79 (see also FIG. 5A). Also mounted on the rear wall 53 is a drive gear 81 driven by a motor, not shown, in order to drive developing rollers 84 and other rollers disposed in the developing unit 40, as will be described later (see also FIG. 5A).

Figure 3:
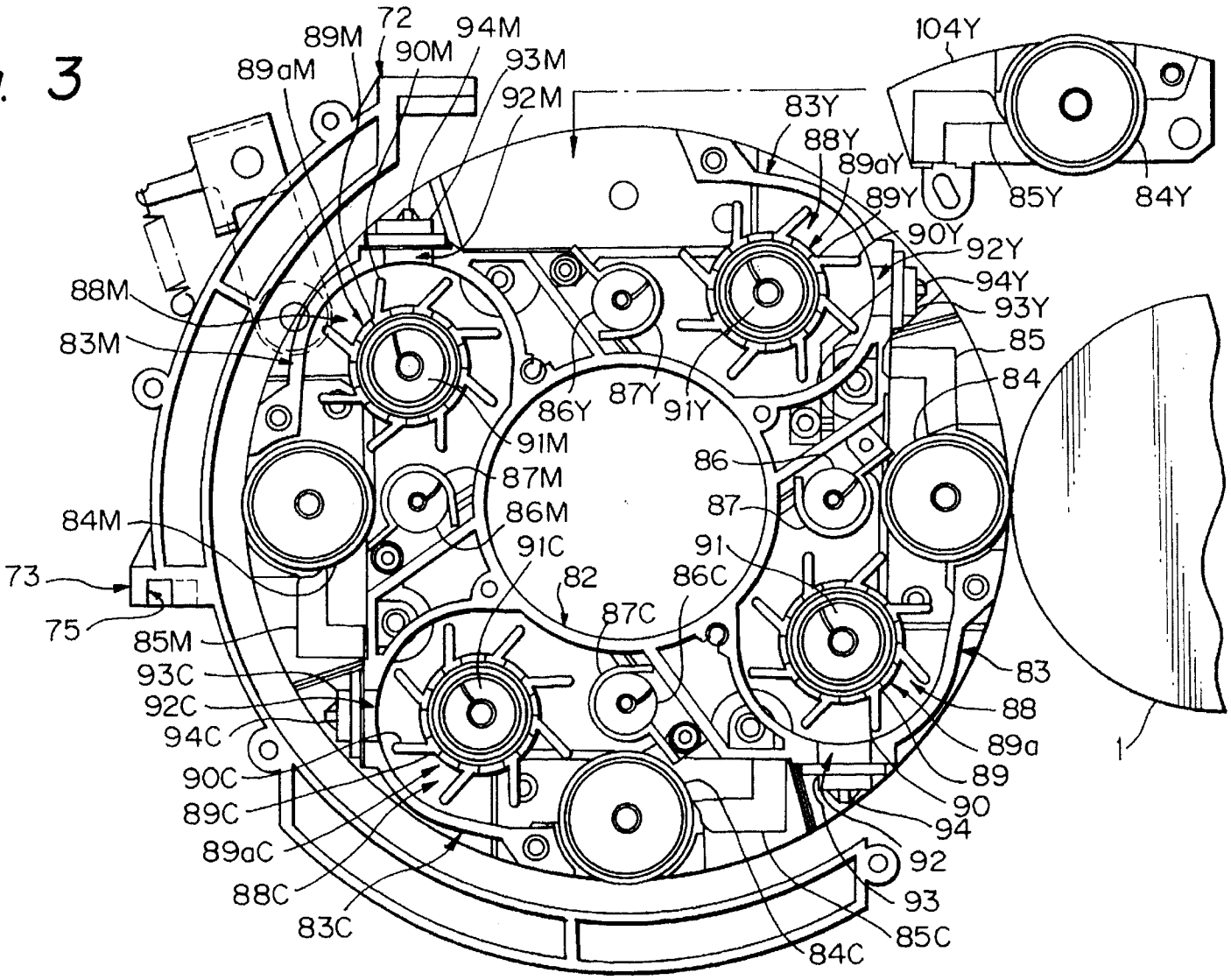
FIG. 3 is a section of a developing unit included in the developing device.

As shown in FIG. 3, the developing unit 40 has a partition extending between the opposite disk-like end walls 50 and 51. The partition consists of a hollow cylindrical portion 82 for accommodating a cylindrical toner cartridge or bottle storing black toner, and four casing portions 83, 83C, 83M and 83Y extending radially from the cylindrical portion 82. The casing portions 83–83Y divide the space around the portion 82 into four chambers having substantially the same shape. Each chamber stores a developer of particular color, i.e., a mixture of carrier and toner of particular color. In the specific position shown in FIG. 3, the chamber facing the drum 1 stores a mixture of carrier and black toner. A chamber storing carrier and yellow toner, a chamber storing carrier and magenta toner, and a chamber storing carrier and cyan toner are sequentially positioned in this order, as seen in the counterclockwise direction.

Because the four developing chambers are identical in structure, the following description will concentrate on the black developing chamber located at a developing position shown in FIG. 3. The members constituting or disposed in the other chambers are distinguished from the members of the black chamber by suffixes Y, M and C representative of yellow, magenta and cyan, respectively.

The casing portion 83, defining the black developing chamber, is formed with an opening facing the drum 1. A developing roller 84 is disposed in the chamber and partly exposed to the outside via the opening. A doctor blade 85, an upper screw 86, a guide 87 guiding the screw 86, and a paddle 88 are also disposed in the chamber. The doctor blade 85 regulates the amount of the developer being conveyed toward the developing position by the roller 84. The screw 86 conveys part of the developer, retained in the chamber by the blade 85, from the rear to the front along the axis thereof. The paddle 88 agitates the developer in the chamber. The paddle 88 has a hollow cylindrical portion 89 formed with a plurality of developer outlets 89*a* in the widthwise direction of the roller 84, and a plurality of blades 90 extending radially from the periphery of the portion 89. A lower screw 91 is positioned in the hollow portion 89 and conveys the developer in the opposite direction to the upper screw 86 along the axis thereof. An opening 92 is formed in the casing portion 83 below the screw 91 and used to replace the deteriorated developer, i.e., to discharge the deteriorated toner and introduce a fresh developer (with toner). A cap 93 is fastened to the casing portion 83 by a screw 94.

Figure 4:
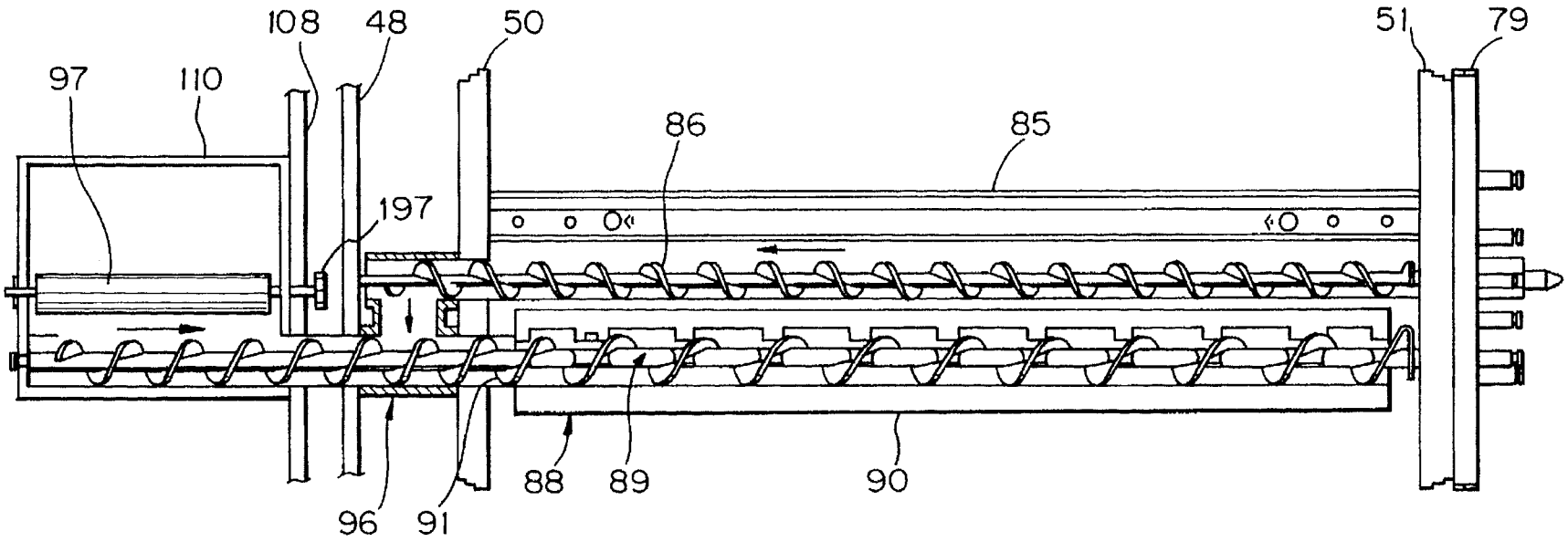
FIG. 4 is a section indicative of connection between a developing chamber and a toner storing section included in the developing device.

As shown in FIG. 4, the front ends of the screws 86 and 91 extend out from the front wall 50 of the developing unit 50. A drop section 96 surrounds the protruding ends of the screws 86 and 91 and causes the developer conveyed by the screw 86 to drop onto the screw 91 due to its own weight. Specifically, the developer removed by the doctor blade 85 and conveyed to the front end by the guide 87 and screw 86 drops onto the screw 91. Then, the screw 91 conveys the developer into the effective width of the developing roller 84. As a result, this part of the developer is returned to the chamber via the outlets 89*a*. The developer is, therefore, agitated in the horizontal direction within the chamber. Further, the developer returned to the chamber via the outlets 89*a* is agitated by the blades of the paddle 88 in the vertical direction. The front end of the upper screw 91 further extends from the drop section 96 to the inside of a case 110 included in the toner cartridge unit 45 for receiving black toner, more specifically to a position below a replenishing roller 97. Cases similar to the case 110 are labeled 91Y, 91M and 91C, respectively.

As FIG. 3 shows by taking the yellow chamber as an example, portions of the opposite end walls supporting a developing roller 84Y and a doctor blade 85Y are each implemented as a small piece 104Y removable from the wall. This configuration allows the small wall pieces 104Y to be removed together with the roller 84Y and blade 85Y and thereby facilitates the cleaning of the chamber or the replacement of parts.

Referring again to FIG. 2, the toner cartridge unit 45 has a disk-like end plate 108 (see FIG. 4) and the cases 91Y, 91M, 91C and 110 mounted on the plate 108 and respectively corresponding to the four developing chambers. The plate 108 is formed with a circular hole, not shown, at the center thereof in order to receive the previously mentioned black toner cartridge. The cases 91Y–110 are mounted on the plate 108 around the hole. The cases 91Y, 91M and 91C assigned to color toners are each formed with a toner inlet which faces upward when the corresponding developing chamber is brought to the developing position. Color toner cartridges 42, 43 and 44 are respectively mounted to mount portions around the toner inlets by being slid in the axial direction of the revolver developing unit. The cartridges 42–44 have an identical configuration, and each stores toner of particular color. The cartridges 42–44 are positioned such that their toner outlets face downward.

The black toner case 110 has a shape substantially identical with the entire circumferential configuration of the color toner cartridges 42–44 respectively mounted to the cases 91Y–91C. A toner inlet is formed in part of the peripheral wall of the case 110 that faces the center line of the revolver developing unit. This toner inlet faces the toner outlet of a black toner cartridge 41.

The black toner cartridge 41 is cylindrical and formed with the toner outlet in the circumferential wall of one longitudinal end. A spiral ridge extends on the inner periphery of the cartridge 41 from the other end of the cartridge 41 to the toner outlet. When the cartridge 41 is rotated integrally with the revolver developing unit, the ridge drives the toner from the rear end toward the front end. As a result, the toner is replenished into the toner inlet of the case 110 via the toner outlet. The cover 47 has a removed portion 47*a*. The cartridge 41 is inserted into the revolver developing unit via the center of the removed portion 47*a* until the rear end reaches the inside of the hollow cylindrical portion 82 of the developing unit 40. In this position, the front end of the cartridge 41 is, for example, substantially flush with the front ends of the cases 91Y–110.

As shown in FIG. 4, the replenishing roller 97 is disposed in each of the black toner case 110 and color toner cases 91Y–91C. The roller 97 is journalled to the front end of the case 110 and the end plate 108 such that it is positioned, when the corresponding chamber is brought to the developing position, substantially just above the extended portion of the lower screw 91 in the case. The shaft of the roller 97 extends throughout the end plate 108 toward the developing unit 40. A gear 197 is mounted on the protruding end of the shaft. An input gear, not shown, is rotatably mounted on the end of the plate 108 facing the developing unit 40. This gear is held in mesh with the gear 197 in order to input a driving force. One of such input gears associated with the roller 97 which corresponds to the chamber located at the developing position is brought into mesh with the gear (see FIG. 2) driven by the motor 61. When the roller 97 is rotated by the motor 61, the fresh toner dropped onto the lower screw 91 is mixed with the developer dropped from the upper screw 86. Hence, the screw 91 conveys the developer and fresh toner to the chamber while mixing them together. As a result, the toner concentration in the chamber is increased.

Figure 5A:
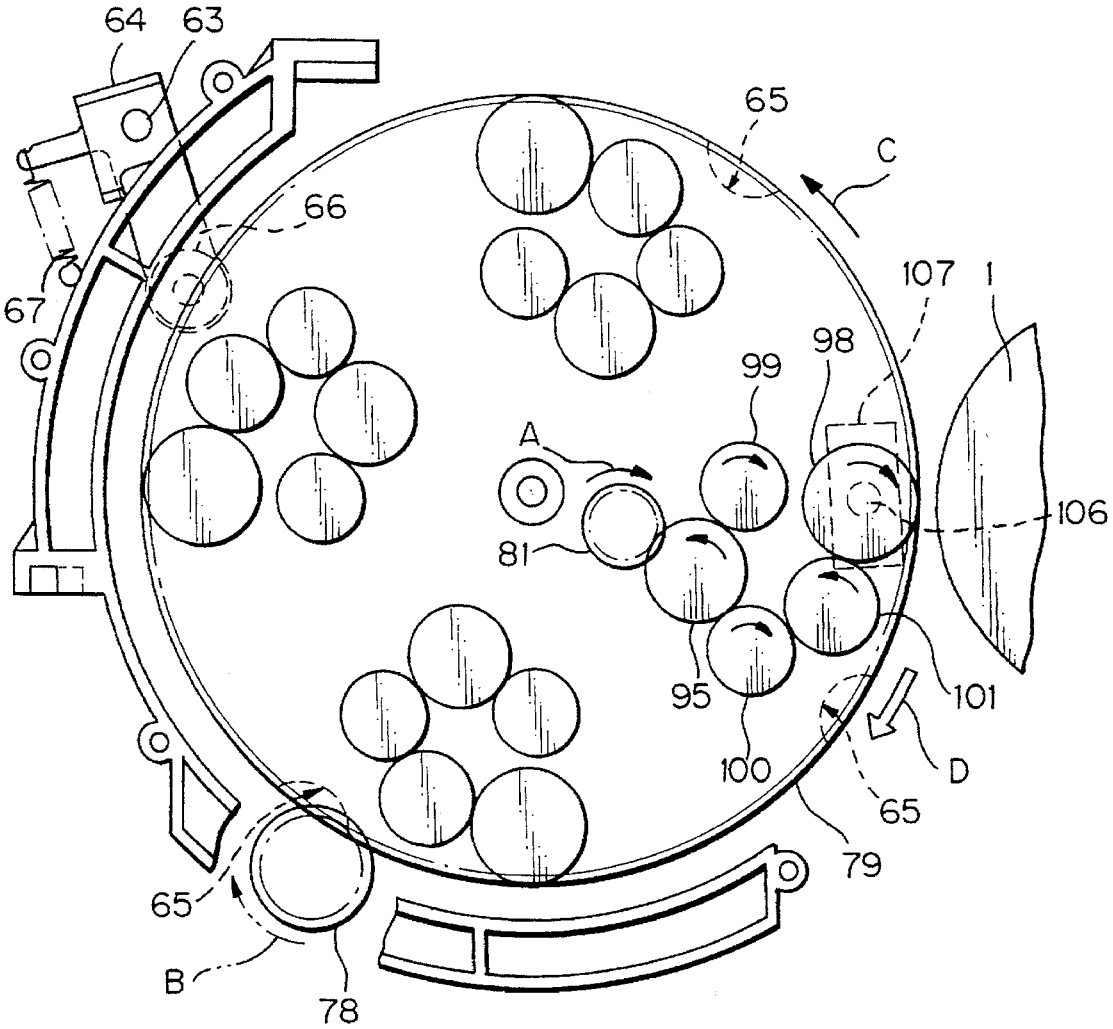
FIGS. 5A and 5B are front perspective views showing an arrangement for driving the developing unit as well as other arrangements.
Figure 5B:
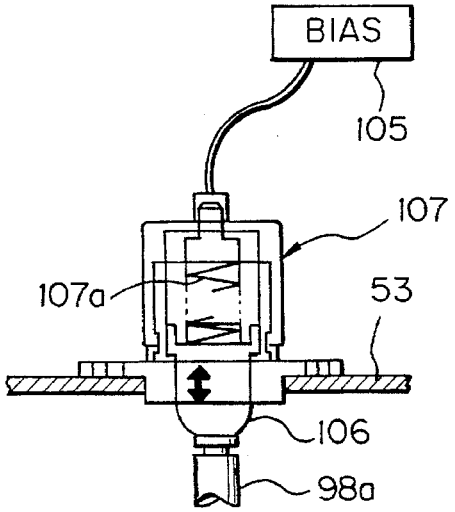

Referring to FIGS. 5A and 5B, there will be described a mechanism for driving the developing rollers and other rotary members of the developing unit 40. As shown, various gears are mounted on the rear end 51 of the unit 40 at the rear of the revolver input gear 79. The gears include gears 98 respectively mounted on the ends of the developing rollers 84 protruding to the rear of the gear 79. Further, gears 99 and 100 are respectively mounted on the screws 86 and 91 protruding to the rear of the gear 79. In the illustrative embodiment, an idle gear 101 is held in mesh with the gears 98 and 100 while a gear 95 is capable of meshing with the output gear 81. The gear 81 is mounted on the rear wall 53 of the printer body and driven by the motor 80. The gears 101 and 95 are mounted on the rear of the rear wall 51. When the casing 46 accommodating the revolver developing unit is inserted into the printer body, the input gear 95 of the unit is brought into mesh with the output gear 81 of the printer body, as shown in FIG. 5A. At the same time, the input gear 79 of the unit is brought into mesh with the output gear 78 of the printer body, as also shown in FIG. 5A.

In the condition shown in FIG. 5A, the output gear 81 is rotated in a direction indicated by an arrow A during the course of development. Therefore, the screw gears 99 and 100 are rotated via the input gear 95. Also, the roller gear 98 is rotated via the screw gear 100 and idle gear 101 to, in turn, rotate the developing roller 84.

To move another developing chamber to the developing position, the revolver input gear 79 is driven by the previously mentioned revolver motor in a direction indicated by an arrow B in FIG. 5A. As a result, the revolver developing unit is rotated in a direction C until the expected chamber arrives at the developing position. At this instant, the positioning roller 66 drops in the recess 65 of the rear wall 51 of the unit, thereby positioning the unit. It is to be noted that the drive gear 81 is rotated in the direction A after the positioning step, a moment of rotation acts on the unit in a direction D. The shape of the recess 65 and the force of the spring 67, biasing the roller 66, are so selected as to position the unit by overcoming the moment of rotation.

In the illustrative embodiment, an arrangement is made such that a bias for development is surely applied to the developing roller 84 from the printer body without exerting any excessive load on the rotation of the revolver developing unit. As shown in FIG. 5B, when one of the developing chambers is brought to the developing position, the end of a developing roller shaft 98*a* disposed in the chamber faces a rod-like terminal 106. The terminal 106 is located at a predetermined position on the rear wall 53 of the printer body and connected to a bias circuit 105. Specifically, the terminal 106 is supported by a bracket 107 in such a manner as to be retractable in the direction in which the casing 46 is slidable. Usually, the terminal 106 protrudes to the front of the printer body under the action of a spring 107*a*. The terminal 106 is provided with a hemispherical convex tip, while the end of the shaft 98*a* is formed with a hemispherical recess having a slightly greater radius of curvature than the convex tip of the terminal 106.

In the above arrangement, the spring 107*a* maintains the terminal 106 in contact with the end of the shaft 98*a*, so that a bias for development can be surely applied to the developing roller 84. When the tip of the terminal 106 and the end of the shaft 98*a* are brought into or out of contact with each other due to the rotation of the revolver developing unit, the terminal 106 is retracted so as to reduce the load on the rotation of the unit. The load is further reduced because of the convex tip of the terminal 106 and the concave end of the shaft 98*a*. In addition, the convex tip allows the terminal 106 to move toward and away from the shaft 98*a* smoothly without regard to the direction of rotation of the unit. Of course, the shaft 98*a* and the terminal 106 may be provided with a convex tip and a concave end, respectively. The retractable terminal 106 further serves to reduce the torque for driving the unit.

Figure 6A:
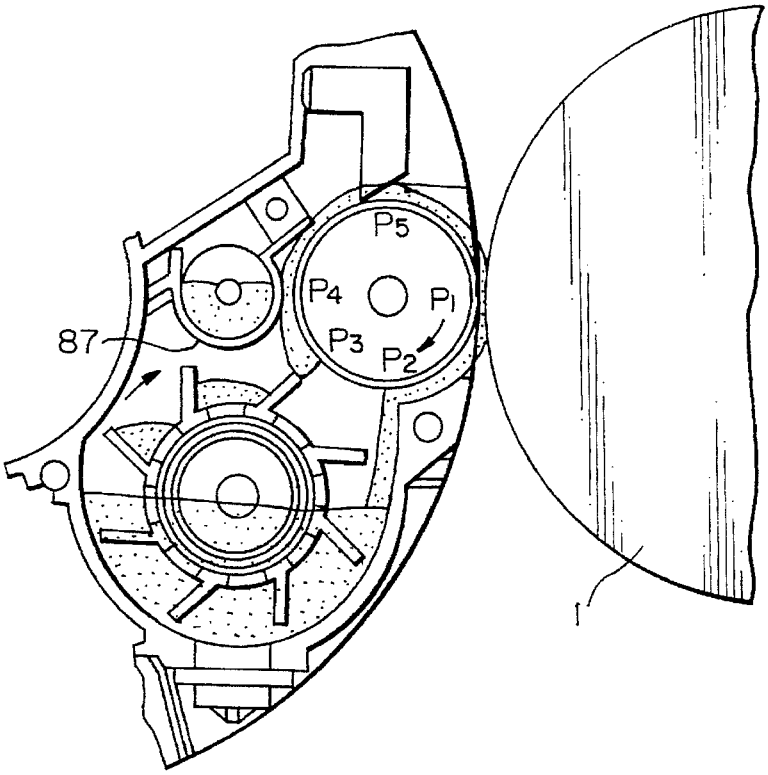
FIGS. 6A and 6B are sections demonstrating a specific procedure for evacuating a developer stored in the developing unit.
Figure 6B:
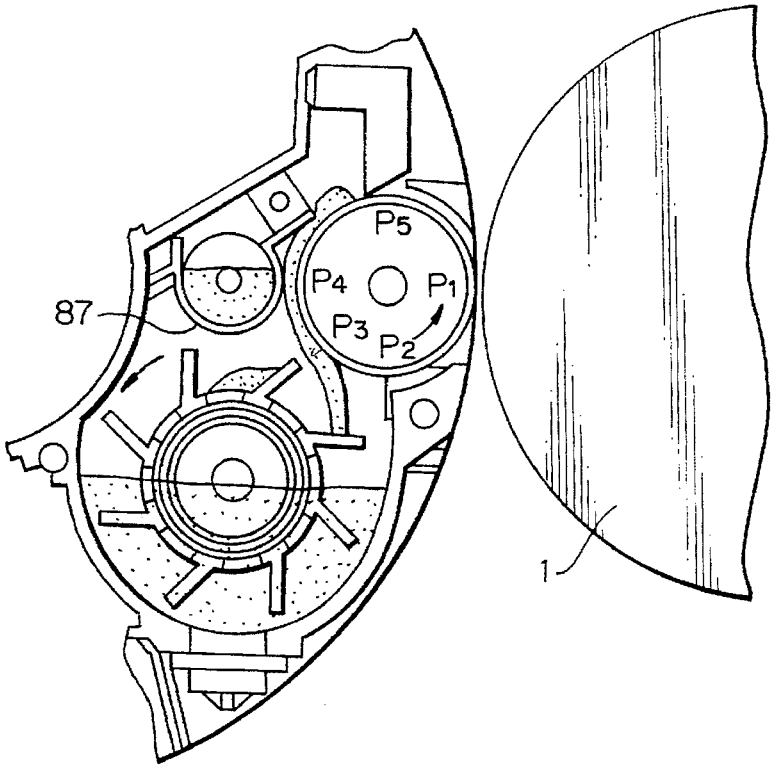

Assume that the revolver developing unit is rotated with the developer existing on the developing roller 84. Then, it is likely that the developer increases the load on the drive of the drum 1 or drops from the roller 84 and contaminates the interior of the printer. To eliminate this problem, the embodiment sets up, before the start of rotation of the unit, a condition wherein the developer is absent at least on part of the developing roller 84 facing the drum 1. FIGS. 6A and 6B show a specific scheme for setting up such a condition. As shown, the sleeve of the roller 84 is rotated in a direction (FIG. 6B) opposite to a direction (FIG. 6A) for usual development for a predetermined period of time. As a result, the developer on the sleeve is collected in the developing chamber.

More specifically, in FIGS. 6A and 6B, a plurality of magnets are fixedly disposed in the sleeve and form a plurality of poles P1–P5. During the course of development, the pole P3 scoops up the developer from the paddle, the poles P4 and P5 convey the developer, and the pole P1 effects development. The developer is dropped from the sleeve at a position between the poles P2 and P3. When the rotation of the sleeve is reversed, as shown in FIG. 6B, the developer is not scooped up from the paddle, but it is dropped from the sleeve at the position between the poles P3 and P2. As a result, no developer is present on the sleeve. A controller, not shown, for controlling the revolver motor and other drive sources is so constructed as to effect the above operation before the start of rotation of the revolver developing unit.

In summary, it will be seen that the present invention provides an image forming apparatus and a power supply device therefor having the following unprecedented advantages.

(1) A developing unit and an apparatus body are provided with a power input terminal and a power output terminal, respectively. One of the two terminals is implemented as a retractable member constantly biased toward the other terminal. Hence, even if the assembly of the unit and printer body is irregular within a certain range, the two terminals can surely contact each other and ensure the power supply to the unit.

(2) Power supply is ensured even if the contact angle of the retractable member with the other terminal is slightly changed. In addition, the retractable member surely contacts even with a protruding end, e.g., the end of a developing roller shaft.

(3) One of two members movable relative to each other is implemented as a member retractable from the other member while being constantly biased toward the other member. Hence, even if the assembly of the unit and printer body is irregular within a certain range, the two members can surely contact each other. Therefore, the power supply from one of them to the other is positive.

(4) When the unit is rotated to replace a developing chamber, a condition wherein a developer is absent at least on part of a developer carrier exposed to the outside is set up, and then the unit is rotated. As a result, the developer is prevented from contacting an image carrier despite the rotation of the unit. Hence, the fall of the developer from the developer carrier is reduced. In addition, the absence of the developer in the above condition obviates the load on the drive of the image carrier and affects image writing on the image carrier little, compared to a case wherein the unit is rotated with a developer layer intervening between the developer carrier and the image carrier.

Various modifications will become possible for those skilled in the art after receiving the teachings of the present disclosure without departing from the scope thereof.

What is claimed is:

1. An image forming apparatus having a rotary developing device having a plurality of developing sections arranged around an axis of rotation and rotatable to bring any one of said plurality of developing sections to a developing position where an image carrier is located, said apparatus comprising:

a power input terminal located at a predetermined position on one end of said rotary developing device in an axial direction of said rotary developing device; and a power output terminal located at a predetermined position on a body of said apparatus which faces a path on which said power input terminal moves during rotation of said rotary developing device;

wherein one of said power input terminal and said power output terminal comprises a hemispherical tip constantly biased toward and retractable from the other terminal, and wherein power is supplied from said body to said developing unit when said hemispherical tip contacts said other terminal by rotation of said rotary developing device.

* * * * *